United States Patent [19]

Daniels

[11] Patent Number: 5,076,500

[45] Date of Patent: Dec. 31, 1991

[54] NOZZLE JET CARTRIDGE ASSEMBLY FOR WHIRLPOOL BATHS

[75] Inventor: Charles L. Daniels, Las Vegas, Nev.

[73] Assignee: Hydr-O-Dynamic Systems, Inc., Las Vegas, Nev.

[21] Appl. No.: 456,663

[22] Filed: Dec. 27, 1989

[51] Int. Cl.[5] ..... B05B 15/08

[52] U.S. Cl. ..... 239/587; 239/600; 239/428.5; 4/542

[58] Field of Search ..... 239/587, 390, 596, 600, 239/428.5; 4/492, 541, 542; 285/33, 355, 331

[56] References Cited

U.S. PATENT DOCUMENTS

| | | | |
|---|---|---|---|
| 2,316,135 | 4/1943 | Turek et al. | 239/587 |
| 4,221,336 | 9/1980 | Diamond | 239/587 |
| 4,349,923 | 9/1982 | Chalberg | 4/492 |
| 4,420,846 | 12/1983 | Bonner | 4/541 |
| 4,541,780 | 9/1985 | Moreland | 4/541 |
| 4,717,078 | 1/1988 | Arp | 239/587 |
| 4,731,887 | 3/1988 | Henkin et al. | 4/492 |
| 4,852,190 | 8/1989 | Jacuzzi et al. | 4/542 |
| 4,919,338 | 4/1990 | Junk | 239/587 |

FOREIGN PATENT DOCUMENTS

| | | | |
|---|---|---|---|
| 2112670 | 7/1983 | United Kingdom | 4/542 |

*Primary Examiner*—Andres Kashnikow
*Assistant Examiner*—Christopher Trainor
*Attorney, Agent, or Firm*—David O'Reilly

[57] ABSTRACT

A nozzle jet cartridge assembly for whirlpool bathtubs and the like in which an eyeball or spherical nozzle jet is mounted in a cylindrical housing. The spherical nozzle jet is positioned in the housing by a retaining ring and spring and the housing is closed by a locking ring. This assembly provides a nozzle jet cartridge which can be easily installed in a socket provided by a coupling fitting a hole in the wall of a whirlpool tub. An interchangeable trim ring and a locking nut secure the nozzle jet cartridge assembly to the tub wall.

24 Claims, 2 Drawing Sheets

NOZZLE JET CARTRIDGE ASSEMBLY FOR WHIRLPOOL BATHS

FIELD OF THE INVENTION

This invention relates to whirlpool bath nozzle jets and more particularly relates to a compact nozzle jet cartridge assembly.

BACKGROUND OF THE INVENTION

Therapeutic whirlpool baths and spas use a number of nozzle jets spaced around the tub to direct jets of air and fluid to provide agitation to water in the tub. These jets are spaced at various locations around the interior sidewall of the tub and are adjustable to direct water in a selected direction.

The nozzle jets are usually installed in a fitting between a Venturi jet fitting and a face plate on the tub surface. Installation requires a number of parts to install and seal the nozzle jet. The parts include couplings, face plates, and seals and increase the possibility of improper installation and consequent failure of the assembly. This possibility is increased when the user has to clean the nozzle jet of debris and corrosion. Replacement of parts in their correct sequence or loss of the small parts that form the assembly are all too easy and create problems for the user and installer.

It would be advantageous if a nozzle jet assembly could be provided that is easily installed, has consistant action, and is easily moved and controlled. Additionally, it would be advantageous if the nozzle jets could be easily installed or removed for maintenance or replacement by the user.

It is, therefore, one object of the present invention to provide a unique nozzle jet cartridge assembly which can be easily installed or removed for cleaning or replacement.

Yet another object of the present invention is to provide a nozzle jet assembly in which controlled movement is always the same.

Yet another object of the present invention is to provide a nozzle jet assembly in which smooth, easily controlled movement is preset during manufacturing.

Still another object of the present invention is to provide a nozzle jet assembly which may be easily removed to change the style of trim finish or nozzle jet.

Still another object of the present invention is to provide a nozzle jet assembly which eliminates the possibility of improper installation and prevents the possibility of lost parts when removed for maintenance or replacement.

BRIEF DESCRIPTION OF THE INVENTION

The purpose of the present invention is to provide a nozzle jet assembly in the form of a cartridge which can be easily removed and replaced to prevent the possibility of improper installation by an installer or user.

Whirlpool bathtubs and spas have as many as six and sometimes more nozzle jet assemblies spaced approximately equally around the sidewall of the tub. With the present invention, these nozzle jet assemblies are in the form of a cartridge in which a spherical nozzle jet, having a tapered bore, is installed in a hollow cylindrical housing or barrel and held in place by a retaining ring, a spring, and a locking ring.

The cartridge is installed in a housing assembly comprised of a face plate providing the exterior trim and a wall fitting for attaching a Venturi jet to supply water and air. The wall fitting has a socket for receiving the cartridge nozzle jet assembly and a threaded nipple for receiving a clamping nozzle jet Venturi. A retaining ring holds the spherical nozzle jet against a flange on the hollow cylindrical housing, allowing smooth, easy movement while maintaining a consistent seal.

Removing the cartridge is a simple procedure of unscrewing the face plate and slipping out the cartridge for maintenance or replacement. There are no loose parts to get lost or make reinstallation difficult.

The above and other novel features and advantages of the invention will be more fully understood from the following detailed description and the accompanying drawings, in which:

DETAILED DESCRIPTION OF THE INVENTION

Figure 1:
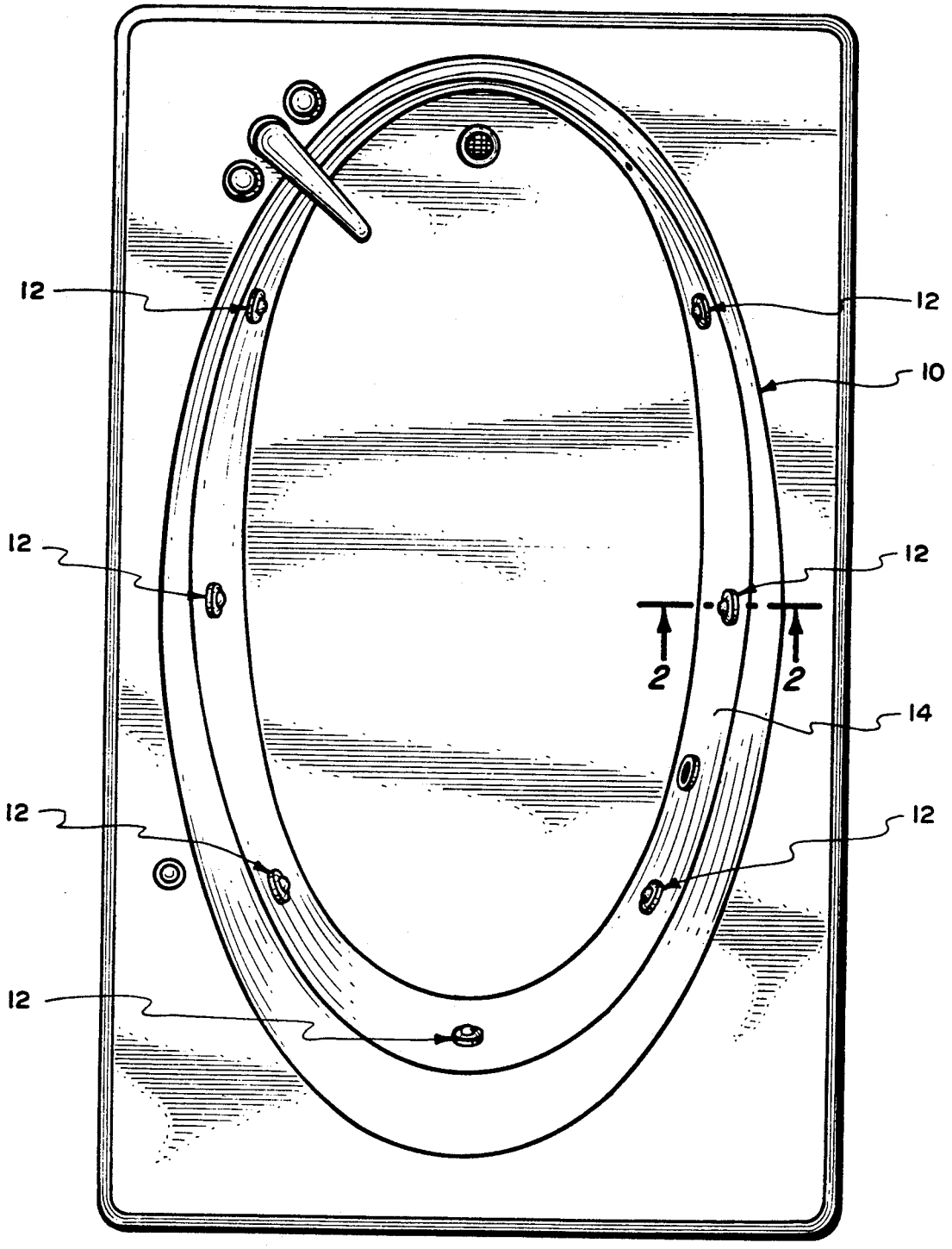
FIG. 1 is a top elevational view of a whirlpool bathtub having a plurality of nozzle jet assemblies.

A whirlpool bathtub 10 is illustrated in FIG. 1 having a plurality of nozzle jet assemblies 12 conveniently spaced around the interior wall 14. These tubs are operated by a pump (not shown) that causes a high volume of water and air to flow from the nozzle jet assemblies 12 into the tub filled with water to provide agitation and for therapeutic stimulation to the user. The nozzle jet assemblies 12 are adjustable to direct the flow of water in a controlled manner.

A frequent problem with present nozzle jet assemblies is improper installation due to the number of small parts in the assembly. This is a particular problem when a user removes the nozzle jet to clean the nozzle jet of debris or corrosion. Often the number of small parts are reinstalled incorrectly, improperly, or are small enough that they are easily lost. While replacement of lost parts is not impossible, it can be an irritating inconvenience.

Figure 2:
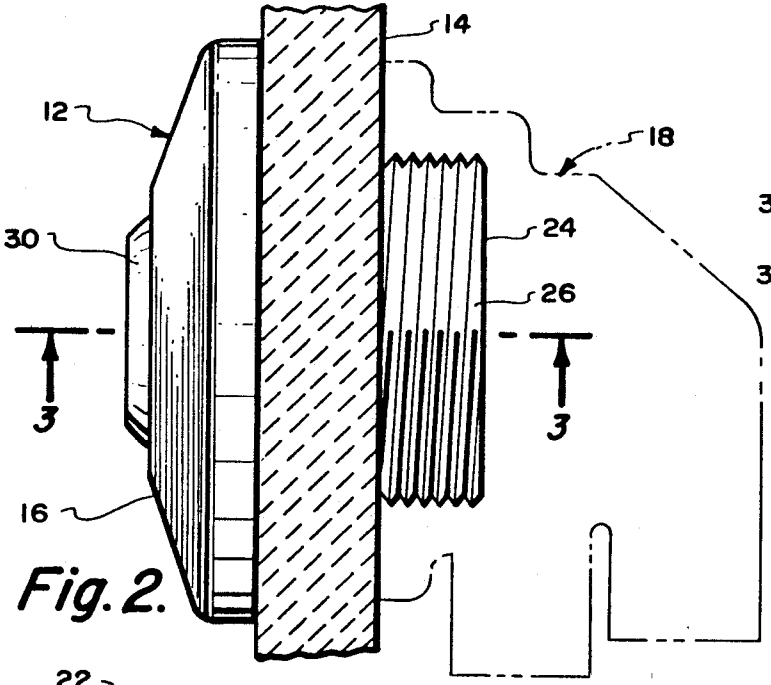
FIG. 2 is a sectional view showing the installation of one nozzle jet assembly taken at 2—2 of FIG. 1.

The present invention is comprised of a unique eyeball nozzle jet assembly in a single cartridge that can be easily removed and replaced in one piece from the wall fitting and mounting assembly 12 (FIG. 1) attached to a wall 14 of a tub as shown in FIG. 2. The eyeball nozzle jet assembly 12 is clamped to wall 14 of tub 10 by a threaded faceplate 16 and a threaded Venturi jet 18 (shown in phantom) behind wall 14.

Figure 3:
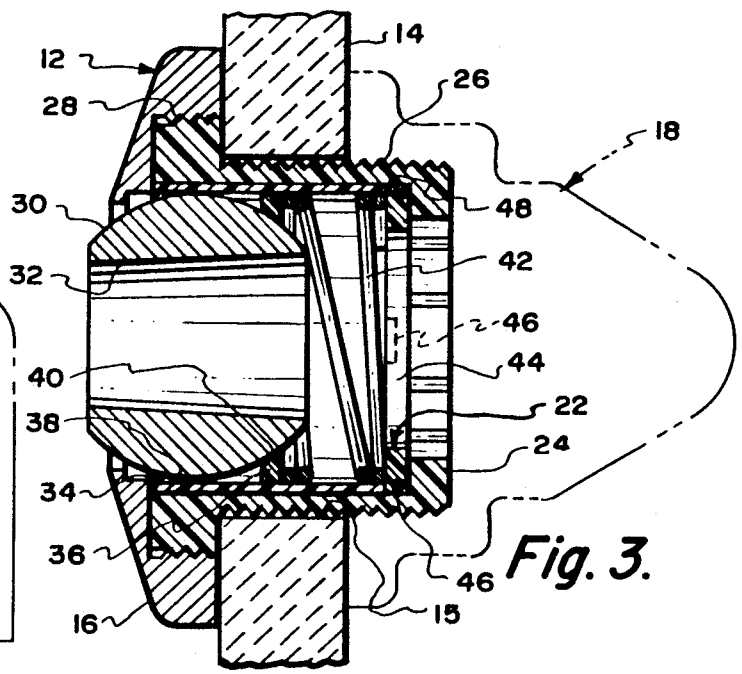
FIG. 3 is a sectional view taken at 3—3 of the nozzle jet assembly of FIG. 2.
Figure 4:
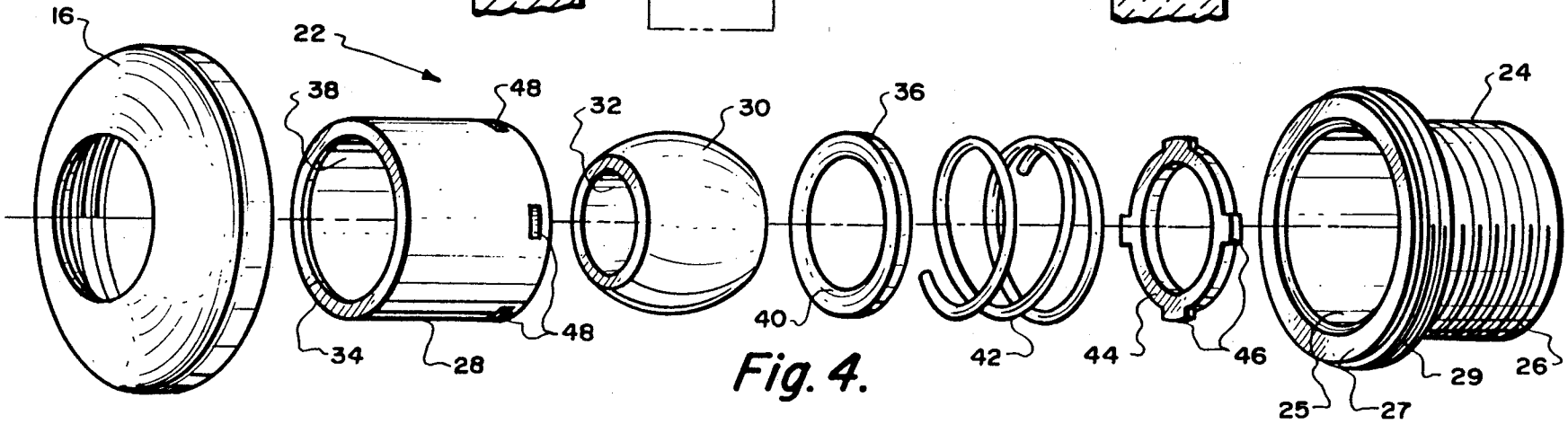
FIG. 4 is an exploded view of the nozzle jet cartridge assembly according to the invention.

The construction of the nozzle jet cartridge assembly 22 is shown in greater detail in FIGS. 3 and 4. The cartridge assembly 22 is mounted in a fitting or coupling 24 providing threads 26 and 29 for mounting faceplate ring 16 and clamping nozzle Venturi jet 18 respectively. Water and air conduits are connected through Venturi jet 18. A seal (not shown) beneath clamping face of Venturi jet fitting 18 seals the assembly against wall 14 of tub 10. Wall fitting 24 has a socket 25 for receiving nozzle jet cartridge assembly 22 and a Venturi jet 18 for attaching air and water supply systems(not shown).

The nozzle jet cartridge assembly 22 is comprised of a cylindrical housing or barrel 28 receiving a spherical nozzle jet 30 having a tapered bore 32. The spherical nozzle jet or ball 30 is retained in cylindrical barrel 38 by flange 34 around the periphery of one end of cylindrical barrel 28 and retaining ring 36 abutting the rear of the nozzle ball 30. Both the flange 34 and the retaining ring 36 are provided with beveled edges forming bearing surfaces 38 and 40 to allow the nozzle jet 30 to easily swivel for smooth, easy adjustment. The retaining ring 36 provides a seat for nozzle ball 30. The beveled edges on flange 34 and retaining ring 36 are formed by 45° chamfers.

The position of the nozzle jet 30 in cylindrical cup 28 is maintained by coil spring 42 abutting retaining ring 36. The cartridge assembly 22 is then completed by installing spring retaining locking ring 44 with tabs 46 engaging slots 48 at the rear of cylindrical barrel 28. This locks nozzle jet 30, retaining ring 36, and spring 42 in cylindrical barrel 28, forming a nozzle jet cartridge assembly 22 that can be easily removed and replaced as a unit. Thus, small parts such as washers, seals, etc., are unnecessary, eliminating the possibility of improper installation or loss of parts.

The wall fitting 24 provides a cylindrical socket 25 and a flange 27 that engages wall 14 of tub 10 to make installation of the nozzle jet assembly relatively simple.

To install the system, the nozzle jet cartridge is assembled as shown in FIG. 4 with nozzle ball 30, retaining ring 36, spring 42, and locking ring 44, all mounted in the cylindrical barrel 28. This cartridge can then be inserted in socket 25 provided in wall fitting 24. The coupling is inserted in hole 15 provided in the wall of tub 10. The assembly is then clamped by threading faceplate 16 onto threads 29 of wall fitting 24 on the exterior side of tub wall 14 with clamping Venturi jet 18 installed on the interior side of wall 14. Venturi jet 18 connects air and water supply hoses (not shown) to the rear of wall fitting 24, providing a completed, unique nozzle jet assembly.

A unique advantage of the above assembly is that the cartridge can be easily withdrawn from socket 25 by removing faceplate trim ring 16 for cleaning or replacement. No small parts that can cause errors in reinstallation or become lost are needed. With the installation described, the function and adjustable action on nozzle eyeball 30 is always the same, very smooth and controlled. Rotation of the spherical nozzle ball 30 in the socket provided by the cylindrical housing 28 allows the jet to be easily controlled and adjusted. Further, rotation of the nozzle eyeball 30 ninety degrees (90°) in the barrel 28 closes the exit path and thus the flow of a fluid through the nozzle jet assembly. With the assembly provided, there also is much less water retention in the socket assembly, reducing the possibility of contamination and corrosion. Another advantage of assembly disclosed is that replacement of the exterior trim ring 16 and cartridge allow the owner to easily change the styling of the trim and spherical nozzle jet finishes as desired.

Obviously, many materials are available to construct the parts of the nozzle jet assembly. It is preferred, however, that the cylindrical housing 28 retaining ring and locking ring 44 be made of some suitable, durable plastic, such as Delrin or ABS. The trim ring 16 can be of a suitable chrome or polished brass finish with the nozzle set or ball 30 being made of plated brass or plastic.

The invention is not to be limited by the embodiments shown in the drawings and described in the description, which are given by way of example and not a limitation, but only in accordance with the scope of the impending claims.

What is claimed is:

1. A nozzle jet assembly for a tub wall fitting comprising;

a cylindrical housing open at both ends;

a retaining flange means at one of said ends of said cylindrical housing;

nozzle jet ball means inserted in said cylindrical housing in abutment with said retaining flange means;

retaining ring means in said cylindrical housing in abutment with an end of said nozzle jet ball means opposite said retaining flange means;

locking ring means at the other end of said cylindrical housing securing said nozzle jet ball means and said retaining ring means inside said cylindrical housing;

removable retaining means for removably securing said locking ring means in said cylindrical housing;

spring biasing means between said retaining ring means and said locking ring biasing said nozzle jet ball means against said retaining flange means;

whereby said cylindrical housing with said nozzle jet ball means secured inside form a removable cartridge for installation in a socket in the tub wall fitting.

2. The nozzle jet assembly according to claim 1 wherein said spring biasing means is a coil spring.

3. The nozzle jet assembly according to claim 1 wherein said removable retaining means comprises tabs on said locking ring means fitted into and secured in slots at the other end of said cylindrical housing.

4. The nozzle jet assembly according to claim 1 wherein a bearing surface is formed on the portion of said retaining ring means in abutment with said nozzle jet ball means, said bearing surface forming a seat for said nozzle jet ball means.

5. The nozzle jet assembly according to claim 4 wherein said flange means on said cylindrical housing has a bearing surface formed on the portion in abutment with said nozzle jet ball means; whereby said respective bearing surface allow smooth swivelling rotational movement to control the direction of flow of fluid through said nozzle jet ball means.

6. The nozzle jet assembly according to claim 5 wherein said respective bearing surfaces are beveled edges on said flange and retaining ring respectively.

7. The nozzle jet assembly according to claim 6 wherein said respective beveled edges are 45° chamfers.

8. The nozzle jet assembly according to claim 1 wherein said locking means is a locking ring fitted into and secured in the other end of said cylindrical housing.

9. The nozzle jet assembly according to claim 8 wherein said removable retaining means includes; a plurality of slots in the wall of said cylindrical housing, adjacent said other end; and a plurality of tabs on said locking ring engaging said plurality of slots to secure said locking ring to said cylindrical housing.

10. The nozzle jet assembly according to claim 1 wherein said nozzle jet ball means can be rotated 90° to close an exit path thereby shutting off the flow of fluids through said nozzle jet assembly.

11. A nozzle jet assembly for a tub wall fitting comprising;

a cylindrical housing open at both ends;

retaining flange means at one of said ends said cylindrical housing;

nozzle jet ball means inserted in said cylindrical housing in abutment with said retaining flange means;

retaining ring means in said cylindrical housing in abutment with an end of said nozzle jet ball means opposite said retaining flange means;

locking ring means at the other end of said cylindrical housing securing said nozzle jet ball means and said retaining ring means inside said cylindrical housing;

said locking ring means including a plurality of equally spaced slots in the wall of said cylindrical housing adjacent the other end and a locking ring having a plurality of tabs that snap into said slots and secure said locking ring in said cylindrical housing.

spring biasing means between said retaining ring means and said locking ring for biasing said nozzle jet ball means against said retaining flange means;

whereby said cylindrical housing with said nozzle jet ball means secured inside form a removable cartridge for installation in a socket in the tub wall fitting.

12. The nozzle jet assembly according to claim 11 wherein there are four of said slots and tabs equally spaced on said cylindrical housing and said locking ring respectively.

13. The nozzle jet assembly according to claim 11 wherein a bearing surface is formed on the portion of said retaining ring in abutment with said nozzle jet ball means, said bearing surface forming a seat for said nozzle jet ball means.

14. The nozzle jet assembly according to claim 11 wherein said flange means on said cylindrical housing has a bearing surface formed on the portion in abutment with said nozzle jet ball means; whereby said respective bearing surfaces allow smooth swivelling rotational movement to control the direction of flow of fluid through said nozzle jet ball means.

15. The nozzle jet assembly according to claim 14 wherein said respective bearing surfaces are beveled edges on said flange means and retaining ring means respectively.

16. The nozzle jet assembly according to claim 15 wherein said respective beveled edges are 45° chamfers.

17. A nozzle ball cartridge assembly for a tub wall fitting comprising;

a cylindrical housing open at both ends;

retaining flange means at one of said ends of said cylindrical housing;

nozzle jet ball means inserted in said cylindrical housing in abutment with said retaining flange means;

retaining ring means in said cylindrical housing in abutment with an end of said nozzle jet ball means opposite said retaining flange means;

said retaining flange means and said retaining ring means each having a bearing surface in abutment with said nozzle jet ball means to allow smooth swivelling rotational adjustment to control flow of fluid through said nozzle jet ball means;

locking ring means at the other end of said cylindrical housing securing said nozzle jet ball means and said retaining ring means inside said cylindrical housing;

said locking ring means including a plurality of equally spaced slots in the wall of said cylindrical housing adjacent the other end and a locking ring having a plurality of tabs that snap into said slots and secure said locking ring in said cylindrical housing.

spring biasing means between said retaining ring means and said locking ring means for biasing said nozzle jet ball means against said retaining flange means;

whereby said cylindrical housing with said nozzle jet ball means secured inside form a removable cartridge for installation in a socket in the tub wall fitting.

18. The nozzle jet assembly according to claim 17 wherein said respective bearing surfaces are beveled edges on said flange means and retaining ring means respectively.

19. The nozzle jet assembly according to claim 18 wherein said respective beveled edges are 45° chamfers.

20. A nozzle jet assembly for whirlpool tubs and the like comprising;

a tub wall fitting having a socket;

fastening means for fastening said tub wall fitting to the wall of a tub;

a nozzle jet cartridge constructed and arranged to fit the socket in said tub wall fitting; said nozzle jet cartridge comprising;

a cylindrical housing open at both ends, said cylindrical housing having a retaining flange at one of said ends;

a nozzle jet ball in said cylindrical housing abutting said retaining flange;

retaining ring means abutting the other end of said nozzle jet ball;

biasing means biasing said retaining ring and nozzle jet ball toward said retaining flange; and a locking ring locking said nozzle jet ball, retaining ring and housing means inside said cylindrical housing;

securing means securing said locking ring in said cylindrical housing; said securing means comprising a plurality of slots spaced around the other end of said cylindrical housing and a plurality of tabs on said locking ring engaging said plurality of slots;

whereby said nozzle jet cartridge may be installed in or removed from said socket in said tub wall fitting for cleaning or replacement.

21. The nozzle jet assembly according to claim 20 in which said fastening means comprises a threaded face plate secured to threads on said tub wall fitting; said threaded face plate constructed to secure said nozzle jet cartridge in said socket.

22. The nozzle jet assembly according to claim 20 in which said biasing means comprises a spring between said retaining ring and said locking means.

23. The nozzle jet assembly according to claim 20 in which there are four of said slots equally spaced in said cylindrical housing; said locking ring having four of said tabs equally spaced for engaging said slots.

24. The nozzle jet assembly according to claim 23 in which said retaining flange and retaining ring have beveled bearing surfaces forming a smooth seat for said nozzle jet ball; whereby said respective bearing surfaces allow smooth swivelling rotational movement to control the direction and amount of flow of fluid through said nozzle jet assembly.

* * * * *